US012082615B2

(12) United States Patent
Emmett et al.

(10) Patent No.: US 12,082,615 B2
(45) Date of Patent: Sep. 10, 2024

(54) AEROSOL-GENERATING SYSTEM AND METHOD USING DIELECTRIC HEATING

(71) Applicant: Philip Morris Products S.A., Neuchatel (CH)

(72) Inventors: Robert Emmett, Neuchatel (CH); Ana Isabel Gonzalez Florez, Neuchatel (CH); Luca Natali, Bologna (IT)

(73) Assignee: Philip Morris Products S.A., Neuchatel (CH)

( * ) Notice: Subject to any disclaimer, the term of this patent is extended or adjusted under 35 U.S.C. 154(b) by 349 days.

(21) Appl. No.: 17/628,103

(22) PCT Filed: Jun. 29, 2020

(86) PCT No.: PCT/EP2020/068263
§ 371 (c)(1),
(2) Date: Jan. 18, 2022

(87) PCT Pub. No.: WO2021/013477
PCT Pub. Date: Jan. 28, 2021

(65) Prior Publication Data

US 2022/0248761 A1 Aug. 11, 2022

(30) Foreign Application Priority Data

Jul. 19, 2019 (EP) ..... 19187403

(51) Int. Cl.
*A24F 40/46* (2020.01)
*A24F 40/20* (2020.01)
(Continued)

(52) U.S. Cl.
CPC ..... *A24F 40/46* (2020.01); *A24F 40/20* (2020.01); *A24F 40/48* (2020.01); *A24F 40/51* (2020.01)

(58) Field of Classification Search
CPC ..... A24F 40/46; A24F 40/48; A24F 40/20; A24F 40/51
(Continued)

(56) References Cited

U.S. PATENT DOCUMENTS 5,613,505 A * 3/1997 Campbell ..... H05B 6/365 131/194
10,201,186 B2 * 2/2019 Alarcon ..... H05B 1/0252
(Continued)

FOREIGN PATENT DOCUMENTS

CN 103315404 A 9/2013
CN 203424283 U 2/2014
(Continued)

OTHER PUBLICATIONS

International Search Report and Written Opinion issued Oct. 9, 2020 in PCT/EP2020/068263 filed Jun. 29, 2020, 11 pages.
(Continued)

*Primary Examiner* — Gary F Paumen
(74) *Attorney, Agent, or Firm* — Oblon, McClelland, Maier & Neustadt, L.L.P.

(57) ABSTRACT

An aerosol-generating device for heating an aerosol-forming substrate to generate an aerosol is provided, the aerosol-generating device including: a substrate cavity configured to receive an aerosol-forming substrate; and an electromagnetic field generator including a solid state radio frequency (RF) transistor and being configured to generate a RF electromagnetic field in the substrate cavity. A method for generating an aerosol from an aerosol-forming substrate is also provided. An aerosol-generating article is also provided.

15 Claims, 7 Drawing Sheets

(51) Int. Cl.
*A24F 40/48* (2020.01)
*A24F 40/51* (2020.01)

(58) Field of Classification Search
USPC ..... 131/329
See application file for complete search history.

(56) References Cited

U.S. PATENT DOCUMENTS

| | | | | |
|---|---|---|---|---|
| 11,241,042 | B2 * | 2/2022 | Hatrick | A24D 1/20 |
| 11,559,070 | B2 * | 1/2023 | Van Erp | A21D 15/06 |
| 11,864,279 | B2 * | 1/2024 | Alarcon | H05B 1/0252 |
| 2015/0272219 | A1 | 10/2015 | Hatrick et al. | |
| 2016/0057811 | A1 | 2/2016 | Alarcon et al. | |
| 2017/0079326 | A1 * | 3/2017 | Mironov | H05B 6/108 |
| 2017/0079330 | A1 | 3/2017 | Mironov et al. | |
| 2017/0119054 | A1 * | 5/2017 | Zinovik | H05B 6/02 |
| 2018/0007972 | A1 | 1/2018 | Thorens | |
| 2018/0271150 | A1 | 9/2018 | Sparklin et al. | |
| 2019/0239566 | A1 | 8/2019 | Alarcon et al. | |
| 2019/0297949 | A1 | 10/2019 | Mironov et al. | |
| 2020/0068930 | A1 | 3/2020 | Van Erp | |
| 2020/0178578 | A1 | 6/2020 | Van Erp | |

FOREIGN PATENT DOCUMENTS

| | | | |
|---|---|---|---|
| CN | 108552612 | A | 9/2018 |
| CN | 108777893 | A | 11/2018 |
| CN | 109567275 | A | 4/2019 |
| CN | 208708751 | | 4/2019 |
| EA | 009532 | B1 | 2/2008 |
| EP | 3 145 345 | A1 | 3/2017 |
| EP | 3 747 289 | A1 | 12/2020 |
| JP | 58-188089 | A | 11/1983 |
| JP | 2006-302721 | | 11/2006 |
| JP | 2008-41398 | A | 2/2008 |
| JP | 5128025 | | 11/2012 |
| JP | 2018-81908 | A | 5/2018 |
| RU | 2 611 487 | C2 | 2/2017 |
| RU | 2 643 422 | C2 | 2/2018 |
| RU | 2 670 534 | C1 | 10/2018 |
| RU | 2 687 754 | C1 | 5/2019 |
| RU | 2 687 765 | C1 | 5/2019 |
| RU | 2 693 705 | C2 | 7/2019 |
| WO | WO 2018/206637 | A1 | 11/2018 |
| WO | WO 2019/111103 | A1 | 6/2019 |

OTHER PUBLICATIONS

Combined Russian Office Action and Search Report issued Oct. 16, 2023 in Russian Patent Application No. 2022103574/03 (with English Translation), 17 pages.

"Solid State Cooking", https://www.ampleon.com/applications/rf-energy/solid-state-cooking.html, 2019, 4 pages.

"RF Power LDMOS Transistor N-Channel Enhancement-Mode Lateral MOSFET", MHT1003NR, Dec. 2014, Retrieved from the Internet: URL: https://www.nxp.com/files-static/rf_if/doc/data_sheet/MHT1003N.pdf, 17 pages.

"RF Power LDMOS Transistors N-Channel Enhancement-Mode Lateral MOSFETs" MHT1002N3 MHT1002GNR3, Apr. 2015, Retrieved from the Internet: URL: https://www.nxp.com/docs/en/data-sheet/MHT1002N.pdf, 20 pages.

Wesson, R., et al., "RF Solid State Cooking White Paper", Ampleon, Retrieved from the Internet: https://www.ampleon.com/documents/white-paper/Ampleon-RF-Solid-State-Cooking-Whitepaper.pdf, pp. 1-13.

Wesson, R., et al., "Trends in RF and Microwave Heating: Special Issue on Solid-State Microwave heating", Jul. 7, 2016, Ampere Newsletter, Issue 89, 13 pages.

Murphy, M., "Here Comes the Solid-State RF Energy Evolution", Oct. 3, 2018, 12 pages.

Schwartz. E., et al., "Transistor-Based Miniature Microwave Heater", Retrieved from the Internet: https://www.researchgate.net/publication/304743428, Aug. 2006, 7 pages.

Extended European Search Report issued Feb. 20, 2020 in European Patent Application No. 19187403.1, 8 pages.

Japanese Office Action mailed on Jun. 25, 2024 issued in Japanese Patent Application No. 2022-502281, with English Translation, total 12 pages (citing documents 1-2, 15-19, therein).

* cited by examiner

AEROSOL-GENERATING SYSTEM AND METHOD USING DIELECTRIC HEATING

The invention relates to a system and method for generating an aerosol from an aerosol-forming substrate. In particular, the disclosure relates to system and method for heating an aerosol-forming substrate to generate an aerosol for inhalation by a user.

There are many different types of personal vaporisers and heat-not-burn products available that generate an inhalable aerosol from an aerosol-forming substrate. Some of these systems heat a liquid composition and others heat a solid tobacco mixture. Almost all available systems heat the aerosol-forming substrate by conduction of heat from a heating element to an aerosol-forming substrate. Most commonly this is achieved by passing an electrical current through an electrically resistive heating element, giving rise to Joule heating of the heating element. Inductive heating systems have also been proposed, in which Joule heating occurs as a result of eddy currents induced in a susceptor heating element.

One problem with these systems is that they give rise to non-uniform heating of the aerosol-forming substrate. The portion of the aerosol-forming substrate closest to the heating element is heated more quickly or to a higher temperature than portions of the aerosol-forming substrate more remote from the heating element. To mitigate this problem, various designs have been used. Some designs use multiple heating elements to provide the ability to distribute heat or to heat different portions of the substrate at different times. Other designs transport only a small portion of the aerosol-forming substrate to a heating element so that only that small portion is vapourised, before transporting another portion of the aerosol-forming substrate to the heating element.

It would be desirable to be able to provide uniform heating of an aerosol-forming substrate in an manner that allows for greater design flexibility and that allows for heating control, while still being realisable in a compact handheld system.

In this disclosure, there is provided an aerosol-generating device for heating an aerosol-forming substrate to generate an aerosol, the aerosol-generating device comprising: a substrate cavity configured to receive an aerosol-forming substrate; and an electromagnetic field generator configured to generate a radio frequency (RF) electromagnetic field in the substrate cavity, the electromagnetic field generator comprising a solid state RF transistor.

The device can give rise to dielectric heating of the aerosol-forming substrate. Dielectric heating can be uniform within a volume of aerosol-forming substrate, without the creation of hot spots. The heating also requires no contact between a heating element and the aerosol-forming substrate. This means that there is no need to clean a heating element that has a build-up of aerosol residue on it. The device allows for considerable design flexibility in terms of the shape, volume and composition of the aerosol-forming substrate and correspondingly the shape and volume of the substrate cavity.

The use of a solid state RF transducer allows the device to be made compact. The production of a device that can fit easily into one hand of a user is possible. The conventional means for producing RF frequency radiation for heating, such as in domestic microwave ovens, is a magnetron. Magnetrons are bulky and require very high voltages to operate, making them unsuitable for a handheld device. Furthermore, magnetrons have a relatively unstable frequency output and have a relatively short service life. A RF transistor can provide for consistent operation over many more usage cycles and requires much lower operating voltages.

Advantageously, the solid state RF transistor is configured to generate and amplify the RF electromagnetic field. Using a single transistor to provide both the generating and amplification of the RF electromagnetic field allows for a compact device to be made.

As used herein, radio frequency (RF) means a frequency between 3 Hz and 3 THz, and includes microwaves. Preferably, the RF electromagnetic field has a frequency between 500 Mhz and 50 GHz, more preferably between 900 MHz to 30 GHz. The RF electromagnetic field may have a frequency between 900 Mhz and 5 Ghz. In one embodiment the RF electromagnetic field has a frequency of about 2.4 GHz.

As used herein, the term "aerosol-forming substrate" relates to a substrate capable of releasing volatile compounds that can form an aerosol. Such volatile compounds may be released by heating the aerosol-forming substrate. An aerosol-forming substrate is typically part of an aerosol-generating article.

As used herein, the term "aerosol-generating article" refers to an article comprising an aerosol-forming substrate that is capable of releasing volatile compounds that can form an aerosol. For example, an aerosol-generating article may be an article that generates an aerosol that is directly inhalable by the user drawing or puffing on a mouthpiece. An aerosol-generating article may be disposable. An article comprising an aerosol-forming substrate comprising tobacco may be referred to as a tobacco stick.

As used herein, the term "aerosol-generating device" refers to a device that interacts with an aerosol-forming substrate to generate an aerosol. An aerosol-generating article is separate from and configured for combination with an aerosol-generating device for heating the aerosol-generating article.

As used herein, the term "aerosol-generating system" refers to the combination of an aerosol-generating device with an aerosol-generating article. In the aerosol-generating system, the aerosol-generating article and the aerosol-generating device cooperate to generate an aerosol.

The substrate cavity may comprise one or more external walls formed from a material opaque to the RF electromagnetic field. One or more slots may be formed in the one or more external walls to allow for ingress of the electromagnetic field into the substrate cavity. It is desirable to contain the electromagnetic radiation generated by electromagnetic field generator within the substrate cavity. This is both to provide for efficient heating and to avoid radiation leakage. Such radiation leakage could be damaging to other components of the system, including the electromagnetic field generator itself. It is also desirable to minimise the user's exposure to RF radiation. The external walls can comprise any suitable material that is not transparent to RF radiation, such as aluminium, stainless steel, silver or gold. The external walls may have a polished surface to improve reflection of the RF radiation within the cavity.

However, radiation must be allowed to enter the substrate cavity. Providing one or more slots through which the electromagnetic field can pass, allows the electromagnetic field to enter the substrate cavity. At least one of the one or more slots may have an L-shape, an S-shape, a T-shape or an I-shape.

The substrate cavity may comprise walls that are transparent to the RF electromagnetic field. The aerosol-forming substrate may be encased in a wrapper or container formed from a material opaque to the RF electromagnetic field and one or more slots may be formed in the wrapper or container to allow for ingress of the electromagnetic field.

The substrate cavity may comprise a blind cavity having an open end and a closed end. The substrate cavity may be configured to receive an aerosol-forming article containing the aerosol-forming substrate through the open end. The substrate cavity may be configured to retain the aerosol-forming substrate in the substrate cavity.

The device may comprise a closure or mouthpiece for covering the open end of the substrate cavity in use. The closure or mouthpiece may include a radiation shield configured to reflect RF electromagnetic radiation. Alternatively, or in addition, the aerosol-forming article may include a radiation shield configured to reflect RF electromagnetic radiation. One or more of the radiation shields may be fluid permeable to allow generated aerosol to pass through it. For example, a radiation shield may comprise a metal mesh.

The device may comprise an air inlet and an air outlet. An air flow path may be defined between the air inlet and the air outlet. The air flow path may pass through or past the substrate cavity. In embodiments in which the air flow path passes through the substrate cavity or through the generated RF electromagnetic field, the air flow path may comprise a labyrinthine portion past one or more radiation shielding elements to prevent the escape of RF radiation through the air inlet or the air outlet. Alternatively, or in addition, one of more fluid permeable radiation shielding elements may be provided in the air flow path.

The device may comprise a device housing. The device may comprise a radiation containment cavity within the housing, the radiation containment cavity surrounding or adjacent to the substrate cavity. The radiation containment cavity may be provided to allow the RF electromagnetic field to enter the substrate cavity through one or more slots or entry points. RF radiation may propagate freely within the radiation containment cavity. The radiation containment cavity may comprise a waveguide. The radiation containment cavity may have external walls that are not transparent to RF electromagnetic radiation.

The aerosol-generating device may further comprise a resonating cavity between the substrate cavity and the electromagnetic field generator. As used herein the term "resonating cavity" is a structure that can confine electromagnetic waves of a given frequency. In this case, the frequency of choice of the electromagnetic waves corresponds to the RF region of the spectrum. In order to contain the electromagnetic waves, the resonant cavity is made of a reflective material for that frequency (e.g. metals). The structure can be either hollow or filled with a dielectric material. The goal of a resonant cavity is to allow the electromagnetic waves to bounce back and forth inside in order to reinforce the formation of standing waves and minimize power losses.

The resonating cavity amplifies the RF electromagnetic field at a resonant frequency and can be designed to match the impedance of the electromagnetic field generator and the load, in this case the aerosol-forming substrate in the substrate cavity, so as to optimise absorption of energy by the load and minimise reflection of the radiation from the load. This improves heating efficiency and minimises radiation leakage from the system. The resonating cavity may be positioned between the electromagnetic field generator and the substrate cavity.

The aerosol-generating device may further comprise one or more antennae connected to the electromagnetic field generator and configured to direct the RF electromagnetic field. The one or more antennae may be positioned at least partially in the substrate cavity. In use, the one or more antennae may be positioned at least partially with an aerosol-forming substrate in the substrate cavity. In use, the one or more antennae may be configured to puncture a container holding the aerosol-forming substrate. The one or more antennae may pass through a slot in an external wall of the substrate cavity. The one or more antennae may be positioned at least partially in a radiation containment cavity. The one or more antennae may be positioned in a resonating cavity.

The provision of an antenna to direct the radiation generated by the electromagnetic field generator can improve the efficiency of the device. The one or more antennae may comprise an electrically conductive pin.

With the use of an RF transistor to generate the RF electromagnetic field, it is possible to use a closed loop control scheme. The device may comprise a sensor in or adjacent to the substrate cavity, the sensor providing a signal indicative of a temperature in the substrate cavity, and a controller connected to receive the signal from the sensor and connected to control the electromagnetic field generator in dependence on the signal from the sensor.

The sensor may comprise a temperature sensor that directly measures temperature. Alternatively, or in addition, the sensor may comprise a sampling antenna or a plurality of sampling antennae configured to detect perturbation of the electromagnetic field in the substrate cavity, which is indicative of the temperature in the substrate cavity. The dielectric properties of the aerosol-forming substrate change in dependence on temperature. The frequency or amplitude, or both frequency and amplitude, of the electromagnetic field may be adjusted by the controller based on the signal from the sensor to control the heating provided by the device. In particular, overheating may be detected and underheating may be detected and the frequency and amplitude of the electromagnetic field adjusted accordingly. Malfunctions may be detected. It may also be possible to detect the presence of inappropriate materials in the substrate cavity. If an inappropriate material is detected, then the device can be automatically switch off. Similarly, if the signal for the sensor suggests that no aerosol-forming substrate is present in the substrate cavity, the device can be automatically switched off. This kind of control is not possible if a magnetron is used to generate RF radiation.

It may be desirable to maintain the temperature within the substrate cavity within a predetermined temperature range. It may be desirable to maintain the temperature of the aerosol-forming substrate below a temperature at which the aerosol-forming substrate combusts.

The ability to control the amount of heating provided by the device based on a feedback signal also allows different aerosol-forming substrates to be used. Different aerosol-forming substrates may desirably be heated to different temperatures. So providing a mechanism for temperature control allows optimal conditions to be achieved for different aerosol-forming substrates or different designs of aerosol-forming article.

The aerosol-generating device may further comprise a liquid reservoir and a liquid pump configured to deliver liquid from the liquid reservoir to the substrate cavity. The liquid in the liquid reservoir may comprise water. The liquid in the liquid reservoir may comprise polar molecules susceptible to dielectric heating. For efficient dielectric heating it is beneficial for the aerosol-forming substrate to comprise molecules that absorb RF radiation in the frequency range generated by the electromagnetic field generator. It may be advantageous to add additional liquid to the aerosol-forming substrate just prior to heating or during heating.

The liquid pump may connected to control circuitry. The control circuitry may also be connected to the electromagnetic field generator. The control circuitry may coordinate operation of the liquid pump and the electromagnetic field generator.

The liquid pump may comprise peristaltic pump in combination with a stepper motor, a syringe pump, and osmotic pump or a piezoelectric pump.

The solid state RF transistor may be, for example, a LDMOS transistor, a GaAs FET, a SiC MESFET or a GaN HFET.

The aerosol-generating device may comprise a puff detector configured to detect when a user takes a puff on the aerosol-generating system. As used herein, the term "puff" is used to refer to a user drawing on the aerosol-generating system to receive aerosol.

Preferably, the aerosol-generating device is portable. The aerosol-generating device may have a size comparable to a conventional cigar or cigarette. The aerosol-generating device may have a total length between about 30 millimetres and about 150 millimetres. The aerosol-generating device may have an outer diameter between about 5 millimetres and about 30 millimetres. The substrate cavity may have a diameter between 2 millimetres and 20 millimetres. The substrate cavity may have a length between 2 millimetres and 20 millimetres. The aerosol-generating device may be a personal vaporiser, an e-cigarette or heat-not-burn device.

The device may comprise control circuity. The control circuitry may be configured to control the supply of power to the electromagnetic field generator from the power source. The control circuitry may comprise a microprocessor, a programmable microprocessor, a microcontroller, or an application specific integrated chip (ASIC) or other electronic circuitry capable of providing control. The control circuitry may comprise further electronic components. For example, in some embodiments, the control circuitry may comprise any of: sensors, switches, display elements. The control circuitry may comprise an RF power sensor. The control circuitry may comprise a power amplifier. The power source may be a DC power source. The power source may comprise at least one battery. The at least one battery may include a rechargeable lithium ion battery. As an alternative, the power source may be another form of charge storage device such as a capacitor.

The power source may provide a power of between 0.5 Watts and 30 Watts. The impedance of the electromagnetic field generator may be less than 100 Ohms, and preferably between 50 and 75 Ohms.

In use, an aerosol-forming substrate is received in the substrate cavity. An aerosol-generating system is provided comprising an aerosol-generating device as described above and an aerosol-forming substrate received in the substrate cavity.

The aerosol-forming substrate may comprise a solid. The aerosol-forming substrate may comprise a liquid. The aerosol-forming substrate may comprise a gel. The aerosol-forming substrate may comprise any combination of two or more of a solid, a liquid and a gel.

The aerosol-forming substrate may comprise nicotine, a nicotine derivative or a nicotine analogue. The aerosol-forming substrate may comprise one or more nicotine salt. The one or more nicotine salt may be selected from the list consisting of nicotine citrate, nicotine lactate, nicotine pyruvate, nicotine bitartrate, nicotine pectates, nicotine aginates, and nicotine salicylate.

The aerosol-forming substrate may comprise an aerosol former. As used herein, an "aerosol former" is any suitable known compound or mixture of compounds that, in use, facilitates formation of a dense and stable aerosol and that is substantially resistant to thermal degradation at the operating temperature of the aerosol-generating article. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as triethylene glycol, 1,3-butanediol and glycerine.

The aerosol-forming substrate may further comprise a flavourant. The flavourant may comprise a volatile flavour component. The flavourant may comprise menthol. As used herein, the term 'menthol' denotes the compound 2-isopropyl-5-methylcyclohexanol in any of its isomeric forms. The flavourant may provide a flavour selected from the group consisting of menthol, lemon, vanilla, orange, wintergreen, cherry, and cinnamon. The flavourant may comprise volatile tobacco flavour compounds which are released from the substrate upon heating.

The aerosol-forming substrate may further comprise tobacco or a tobacco containing material. For example, the aerosol-forming substrate may comprise any of: tobacco leaf, fragments of tobacco ribs, reconstituted tobacco, homogenised tobacco, extruded tobacco, tobacco slurry, cast leaf tobacco and expanded tobacco. Optionally, the aerosol-forming substrate may comprise tobacco powder compressed with an inert material, for example, glass or ceramic or another suitable inert material.

In cases where the aerosol-forming substrate comprises a liquid or a gel, in some embodiments, the aerosol-generating article may comprise an absorbent carrier. The aerosol-forming substrate may be coated on or impregnated into the absorbent carrier. For example, the nicotine compound and the aerosol-former may be combined with water as a liquid formulation. The liquid formulation may, in some embodiments, further comprise a flavourant. Such a liquid formulation may then be absorbed by the absorbent carrier or coated onto the surface of the absorbent carrier. The absorbent carrier may be a sheet or tablet of cellulosic-based material onto which the nicotine compound and the aerosol former may be coated or absorbed. The absorbent carrier may be a metallic, polymer or vegetal foam having liquid retaining and capillary properties and onto which the liquid or gel aerosol-forming substrate is coated or absorbed.

There may be different categories of aerosol-generating article, each providing a different user experience. For example, the different categories may comprise articles having different recipes or compositions of aerosol-forming substrates, different concentrations of nicotine or other components and different quantities or thicknesses of aerosol-forming substrate. Aerosol-generating articles belonging to the same category may have the same shape, size or colour to make them identifiable to a user or to an aerosol-generating system or device. An aerosol-generating system or device may be configured to only accept a certain category of aerosol-generating article, for example, by having a recess or space which is shaped or sized to receive only a particular type of aerosol-generating article. The recess or space may be keyed to only receive a complementarily shaped aerosol-generating article.

The aerosol-forming substrate may comprise a liquid filled capsule. The aerosol-forming substrate may comprise a gel filled capsule. The liquid filled capsule or the gel filled capsule may be configured to rupture when the liquid or gel is heated by RF electromagnetic field in the substrate cavity. The liquid filled capsule or the gel filled capsule may comprise one or more valves. The one or more valves may be configured to open when the liquid or gel is heated by RF electromagnetic field in the substrate cavity owing to an increase in pressure within the capsule. The one or more valves may be configured to open when a user draws air through the aerosol-generating system.

There is provided an aerosol-generating article comprising: an aerosol-forming substrate; a mouthpiece through which a user can draw generated aerosol or vapour; and a fluid permeable, radio frequency electromagnetic radiation shield positioned between the aerosol-forming substrate and the mouthpiece.

The aerosol-generating article may be used with an aerosol-generating device as described above. The aerosol-generating article may be received, or partially received, in the substrate cavity. The aerosol-forming substrate may be as described above. The fluid permeable, radio frequency electromagnetic radiation shield may be a metal mesh.

Preferably, the article is configured such that generated aerosol or vapour must pass through the fluid permeable, radio frequency electromagnetic radiation shield in order to reach the mouthpiece. The fluid permeable, radio frequency electromagnetic radiation shield may be positioned adjacent to the mouthpiece or be attached to the mouthpiece.

The aerosol-generating article may comprise a filter in the mouthpiece. The aerosol-generating article may comprise a cooling element. The aerosol-generating article may comprise a spacer.

There is provided a method for generating an aerosol from an aerosol-forming substrate, the method comprising:

placing the aerosol-forming substrate within a substrate cavity of an aerosol-generating device; and generating a radio frequency (RF) electromagnetic field in the substrate cavity using a solid state RF transistor.

The aerosol-forming substrate may be an aerosol-forming substrate, as described above. The aerosol-generating device may be as described above.

The radio frequency (RF) electromagnetic field may have a frequency between 500 Mhz and 50 GHz, more preferably between 900 MHz to 30 GHz. The RF electromagnetic field may have a frequency between 900 MHz and 5 GHz. In one embodiment the RF electromagnetic field has a frequency of about 2.4 GHz. In general, heating efficiency is greater with higher frequency. So using frequencies in the microwave portion of the RF spectrum is desirable.

The method may further comprise sensing a parameter within the substrate cavity and adjusting the radio frequency (RF) electromagnetic field based on the sensed parameter. The parameter may be temperature. The parameter may be electromagnetic field strength. The parameter may be a frequency of an electromagnetic field. The method may comprise adjusting the radio frequency (RF) electromagnetic field based on a combination of sensed parameters.

The method may further comprise injecting a liquid into the aerosol-forming substrate in the substrate cavity.

It should also be appreciated that particular combinations of the various features described above may be implemented, supplied, and used independently.

Embodiments of the present disclosure will now be described, by way of example only, with reference to the accompanying drawings, in which.

Figure 1:
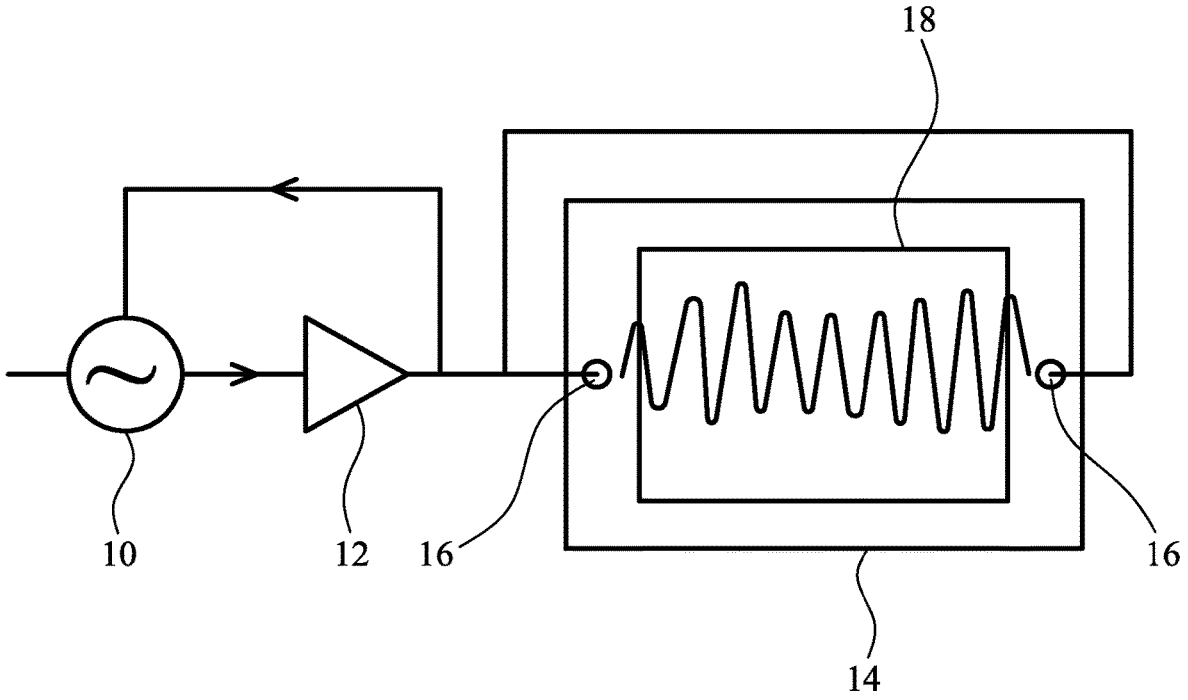
FIG. 1 is a schematic illustration of a dielectric heating system.

FIG. 1 is a schematic illustration of a system for heating using radio frequency electromagnetic radiation, sometimes referred to as dielectric heating. The system comprises a radio frequency signal generator 10, power amplifier 12 connected to the signal generator to amplify the radio frequency signal, and antennae 16 positioned inside the heating cavity 14, the antennae connected to an output of the power amplifier 12. The output of the amplifier is fed back to the signal generator to provide closed-loop control. An object 18 which is to be heated is placed in the cavity 14 and subjected to radiofrequency electromagnetic radiation. Polar molecules within the object 18 aligned with the oscillating electromagnetic field and so are agitated by the electromagnetic field as it oscillates. This causes an increase in temperature of the object 18. This kind of heating has the advantage that it is uniform throughout the object (provided that the polar molecules are uniformly distributed). It also has the advantage of being a non-contact form of heating, which does not require conduction or convection of heat from high temperature heating element. The embodiments described reference to FIGS. 2 to 13 use the basic heating principle illustrated in FIG. 1.

In addition, the embodiments described use a solid state radiofrequency (RF) transistor to perform both the signal generation and power amplification functions illustrated in FIG. 1. However, it would be possible to implement the embodiments described using an RF transistor for the signal generation and a separate electronic component or components to provide for the power amplification.

Figure 2:
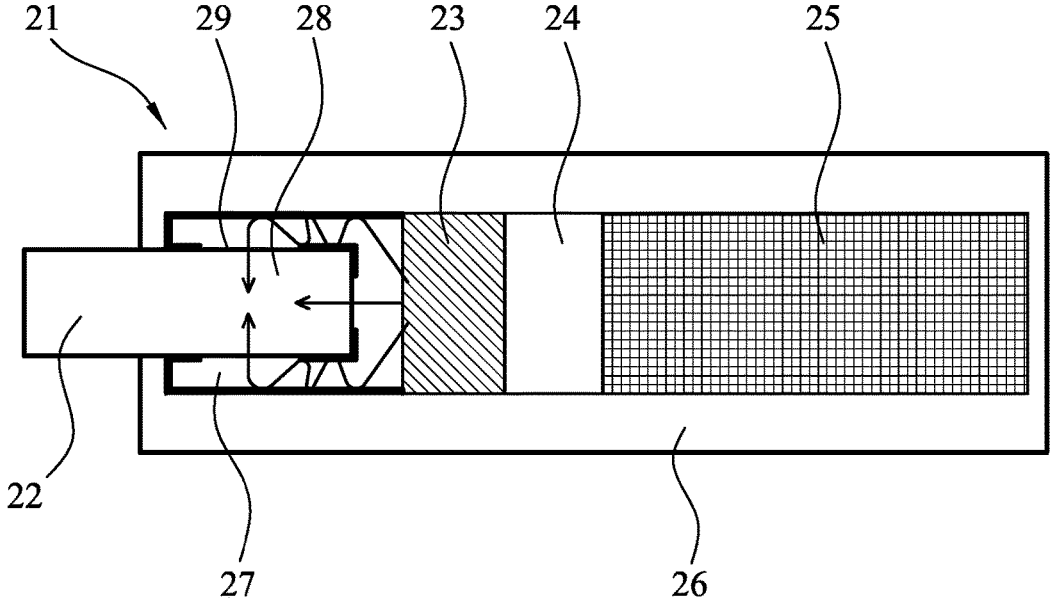
FIG. 2 is a schematic illustration of a first embodiment of an aerosol-generating system.

FIG. 2 is a schematic illustration of a heat-not-burn aerosol-generating system. The system 21 comprises an aerosol-generating article 22 received within the housing 26 of an aerosol-generating device. The aerosol-generating device comprises a power source 25, such as a lithium ion battery, control circuitry 24, an RF electromagnetic field generator 23 comprising a solid state RF transistor, and a substrate cavity 28 in which the aerosol-generating article 22 is received. The RF electromagnetic field generator 23 is provided with power from the battery 25 under the control of the control circuitry 24 to generate radio frequency electromagnetic radiation within the substrate cavity 28.

Surrounding the substrate cavity 28, and positioned between the RF electromagnetic field generator and the substrate cavity, is a radiation containment cavity 27, through which the electromagnetic radiation generated by the RF electromagnetic field generator travels before reaching the substrate cavity 28.

The substrate cavity is generally cylindrical, blind cavity having an open end and a closed end, and a sidewall extending between the open end and the closed end. The aerosol-generating article is inserted into the substrate cavity through its open end. Both the substrate cavity 28 and the radiation containment cavity 27 have external walls formed from suitable metal material, such as aluminium, that is opaque to the RF radiation. This concentrates the electromagnetic field in the substrate cavity and prevents leakage of radiation from the device. In order to allow for radiation to pass from the radiation containment cavity into the substrate cavity, slots 29 are formed in the external walls of the substrate cavity 28. In the example shown in FIG. 2, a slot is formed in the wall at the closed end of the substrate cavity and a further two slots are formed in the sidewall of the substrate cavity.

The aerosol-generating article 22 in this embodiment has the look and feel of a cigarette. It comprises a mouthpiece end on which the user can puff to draw aerosol out of the aerosol-generating system. Opposite the mouthpiece end, the aerosol-generating article holds an aerosol-forming substrate. In this embodiment, the aerosol-forming substrate comprises reconstituted tobacco together with an aerosol former, such as glycerol, and water. The mouthpiece and may comprise a filter.

The aerosol-generating device is designed to be a portable, hand-held device which the user can easily hold in one hand. The housing 26 may be formed of a suitable plastics material, such as polyetheretherketone (PEEK). Airflow inlets (not shown) may be provided in the housing to allow air to be drawn into the device, through the substrate cavity 28 and out through the mouthpiece of the aerosol-generating article.

In operation, after an aerosol-generating article is placed in the substrate cavity, the device is activated. RF radiation from the electromagnetic field generator is then directed into the substrate cavity and causes dielectric heating of the aerosol-forming substrate. In this example, the frequency of the electromagnetic field is between 900 MHz and 2.4 GHz. As will be explained in detail, the temperature inside the substrate cavity can be regulated using a feedback control mechanism. The temperature inside the substrate cavity can be sensed, or another parameter indicative of the temperature inside the substrate cavity can be sensed, to provide a feedback signal to the control circuitry 24. The control circuitry then adjusts the frequency or amplitude, or both the frequency and the amplitude, of the electromagnetic field in order to maintain the temperature inside the substrate cavity within a desired temperature range.

As previously described, the walls of the substrate cavity and the radiation containment cavity are made from a material which is not transparent to RF radiation. For example, aluminium, stainless steel, silver and gold can be used. The walls of the substrate cavity are ideally polished surfaces to improve reflection of the RF radiation. It is also desirable to minimise the escape of RF radiation through the mouthpiece end of the aerosol-generating article. For that purpose, a radiation shielding element may be included within the aerosol-generating article, as illustrated in FIG. 3.

Figure 3:
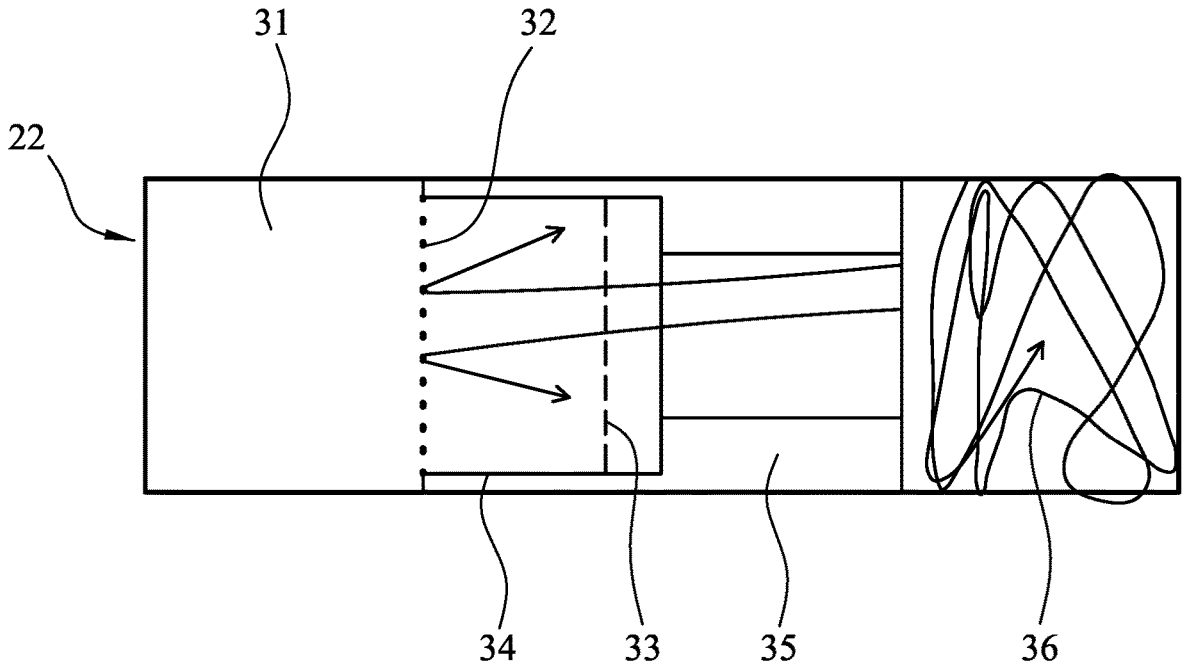
FIG. 3 is a schematic illustration of an aerosol-generating article for use in the system of FIG. 2.

The aerosol-generating article 22 shown in FIG. 3 comprises an aerosol-generating substrate portion 36, which may be a plug of crimped, reconstituted tobacco, together with an aerosol former and water. The aerosol-generating article also comprises a support element 35, which may be a hollow acetate tube, a ventilation portion 34, including laser perforations 33 in an outer wrapper to allow ingress of air, for cooling the generated vapour aerosol, and a mouthpiece filter 31. Between the mouthpiece filter 31 and the cooling portion 34, a metallic mesh radiation shielding element 32 is provided. The radiation shielding element reflects any RF radiation (depicted in FIG. 3 by the arrows) that escapes from the substrate cavity in the direction of the mouthpiece. The provision of the radiation shielding element minimises leakage of radiation towards the mouthpiece and accordingly towards the user of the device. It is necessary that the radiation shielding element is fluid permeable in order to allow the generated aerosol to pass through it to the mouth of the user.

Figure 4:
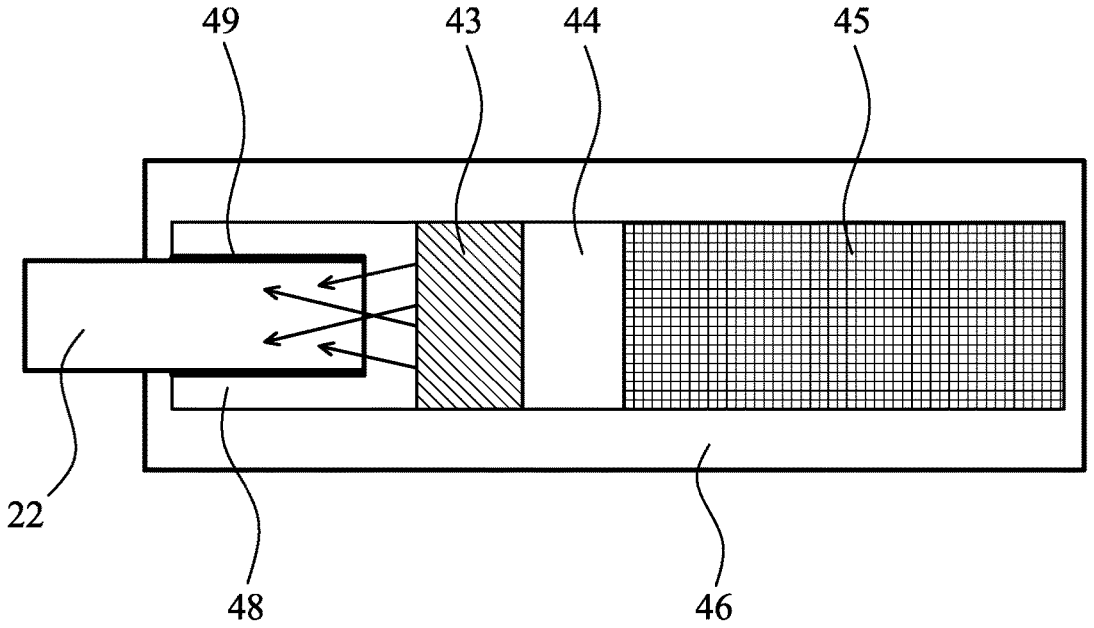
FIG. 4 is a schematic illustration of a second embodiment of an aerosol-generating system.

FIG. 4 illustrates another embodiment of aerosol-generating system, similar to the embodiment illustrated in FIG. 2. However, in the embodiment of FIG. 4, the substrate cavity has walls which are transparent to the RF electromagnetic field. For example, the walls of the substrate cavity 49 may comprise, for example, Teflon, high-purity quartz, or polytetrafluoroethylene. These materials are able to withstand high temperatures and provide surfaces that are smooth and easy to clean. As in the embodiment of FIG. 2, the system comprises an aerosol-generating article 22 received within the housing 46 of an aerosol-generating device. The aerosol-generating device comprises a power source 45, such as a lithium ion battery, control circuitry 44, an RF electromagnetic field generator 43 comprising a solid state RF transistor, and the substrate cavity 49 in which the aerosol-generating article 22 is received. The RF electromagnetic field generator 43 is provided with power from the battery 45 under the control of the control circuitry 44 to generate RF electromagnetic radiation within the substrate cavity 49.

Figure 5:
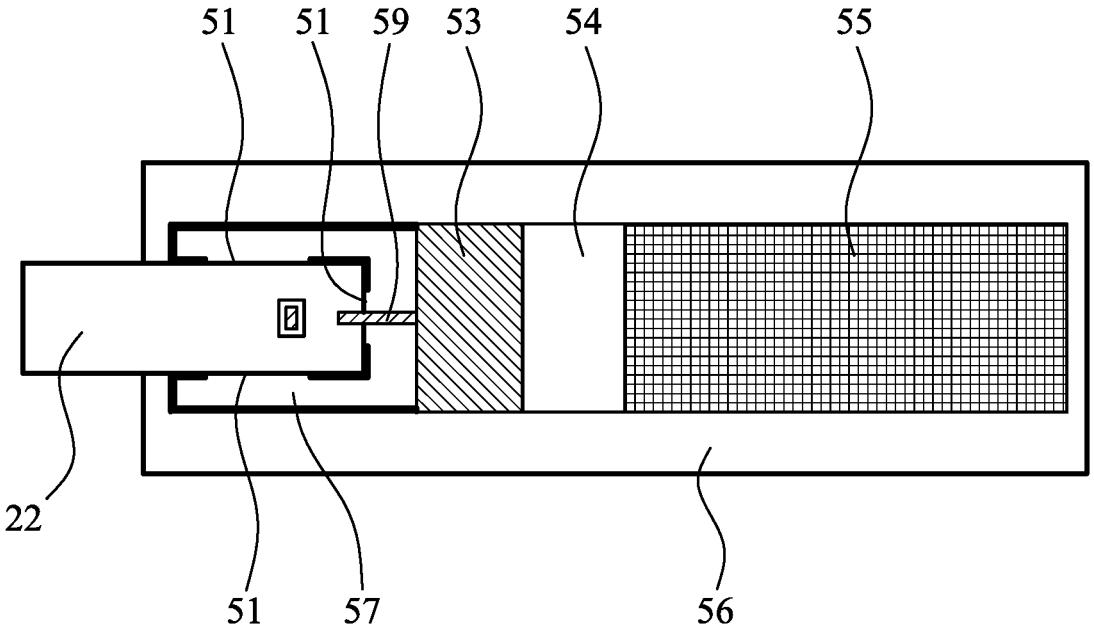
FIG. 5 is a schematic illustration of a third embodiment of an aerosol-generating system.

FIG. 5 illustrates a further embodiment of the invention in which the delivery of the electromagnetic field to the substrate cavity is improved by the provision of an antenna or waveguide 59. The components of the system of the embodiment of FIG. 5 are otherwise the same as that described with reference to FIG. 2. The system comprises an aerosol-generating article 22 received within the housing 56 of an aerosol-generating device. The aerosol-generating device comprises a power source 55, control circuitry 54, an RF electromagnetic field generator 53 comprising a solid state RF transistor, and a substrate cavity 58 in which the aerosol-generating article 22 is received. Surrounding the substrate cavity 58, and positioned between the RF electromagnetic field generator and the substrate cavity, is a radiation containment cavity 57, through which the electromagnetic radiation generated by the RF electromagnetic field generator travels before reaching the substrate cavity 58.

The antenna 59 extends from the electromagnetic field generator 53 into the substrate cavity 58 through a slot 51 formed in the base of the substrate cavity. When the aerosol-generating article is inserted into the substrate cavity, the antenna punctures the aerosol-forming substrate. The antenna 59 delivers the RF electromagnetic radiation directly into the substrate cavity. The antenna 59 may also help to retain the aerosol-generating article within the device. The antenna 59 may be an electrically conductive pin. The RF electromagnetic field can also propagate freely in the radiation containment cavity 57 and enter the substrate cavity through slots 51 in the sidewall of the substrate cavity.

Figure 6:
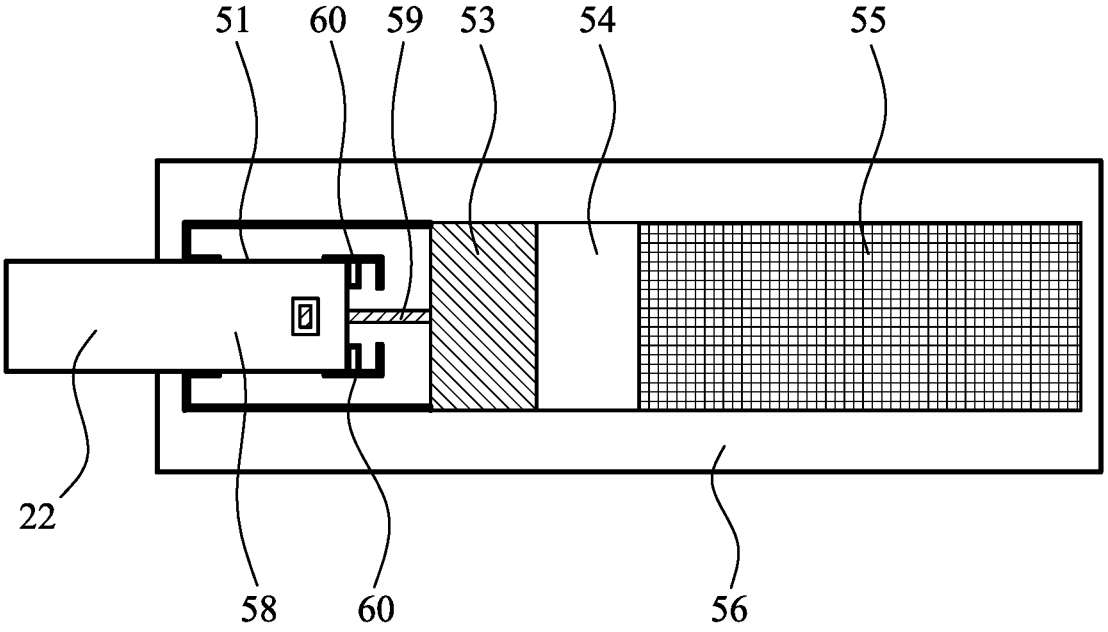
FIG. 6 is a schematic illustration of a fourth embodiment of an aerosol-generating system.

FIG. 6 illustrates a further embodiment almost identical to the embodiment of FIG. 5. The features of FIG. 6 identical to those of the FIG. 5 are labelled with the same reference numerals. In the embodiment of FIG. 6, the antenna 59 extends into the substrate cavity, but in this case, the antenna 59 does not penetrate the aerosol-forming substrate. Stop surfaces 60 are provided within the substrate cavity to prevent the aerosol-generating article from being pushed down onto the antenna 59. This has the advantage that there is no accumulation of condensates or debris on the antenna. But the antenna is still able to deliver the electromagnetic field directly into the substrate cavity.

The efficiency of heating and reduction of radiation leakage can also be improved by the use of a resonating cavity positioned between the RF electromagnetic field generator and the substrate cavity. A system including a resonating cavity is illustrated in FIG. 7.

Figure 7:
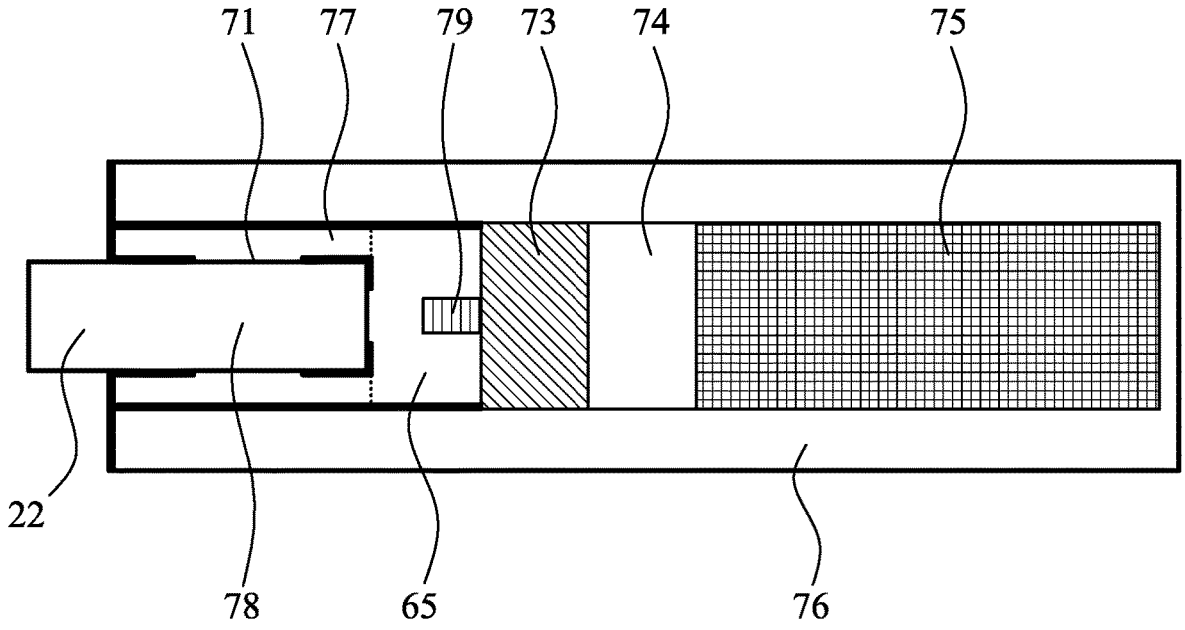
FIG. 7 is a schematic illustration of a fifth embodiment of an aerosol-generating system.

The system of FIG. 7 comprises an aerosol-generating article 22 received within the housing 76 of an aerosol-generating device. The aerosol-generating device comprises a power source 75, control circuitry 74, an RF electromagnetic field generator 73 comprising a solid state RF transistor, and a substrate cavity 78 in which the aerosol-generating article 22 is received. Surrounding the substrate cavity 78, is a radiation containment cavity 77, through which the electromagnetic radiation generated by the RF electromagnetic field generator can travel.

Positioned between the RF electromagnetic field generator and the substrate cavity is a resonating cavity 65. An antenna 79 connected to an output of the electromagnetic field generator 73 is located in the resonating cavity. The walls of the resonating cavity are configured to reflect the RF radiation. The dimensions of the resonating cavity are matched to the frequency of operation of the system so that resonance of the electromagnetic field occurs and the electromagnetic field is amplified at the resonant frequency. The use of a resonating cavity allows for impedance matching between the source, in this case the electromagnetic field generator 73, and the load, in this case the aerosol-forming substrate. If the impedance of the load and source are matched, there will be no reflection of the electromagnetic field from the load back to the source.

In one example, the frequency of operation is 2.4 GHz. The resonant cavity is generally cylindrical and has a length (extending tin the direction between the electromagnetic field generator and the substrate cavity) of 22.75 mm and a diameter of 21.75 mm. The antenna has a length of 8.74 mm. The radiation containment cavity has the same dimensions as the resonating cavity. The substrate cavity, within the radiation containment cavity, has a length of 13 mm and a diameter of 7 mm. The slots between the resonating cavity and the radiation containment cavity and between the radiation containment cavity and the substrate cavity may be rectangular and have dimensions of 1 mm×3 mm.

Dielectric heating is typically most efficient for molecules in the liquid phase, that are freer to move than molecules in a solid phase. Gels, particularly gels that liquefy on heating, can also be effectively heated. For this reason, it is advantageous that the aerosol-forming substrate a certain amount of gel or liquid content. The liquid or gel content can also be beneficial for generating a dense aerosol. In the examples described so far, the aerosol-forming substrate comprises tobacco material. Reconstituted tobacco alone can be heated using dielectric heating. However, soaking or moistening the tobacco with liquid glycerine and water can be advantageous. The water and aerosol former can be provided in capsules within the tobacco in a liquid or gel phase at room temperature. When the liquid or gel in the capsules is heated by dielectric heating it expands. The walls of the capsule can be configured to burst as the liquid or gel expands, or may be configured to melt or disintegrate as the temperature rises. The capsule may be burst just prior to use by the application of mechanical pressure. Alternatively or in addition, the tobacco material can be coated in a composition that is a gel at room temperature but liquefies as the temperature is raised. In these ways, an aerosol-forming substrate can be stored for long periods without the liquid content drying out, and for the liquid to be released only during use.

A further option is to embed liquid capsules that do not burst within the aerosol-forming substrate. The liquid in the capsules is heated by the RF radiation and the heat transferred by conduction from the capsules to the rest of the aerosol-forming substrate.

At least some of the gel or liquid may be selected so that is heated by the RF radiation but is not significantly vapourised at the temperature of operation. In this way the gel or liquid imparts heat to the aerosol-forming substrate but the liquid or gel content of the substrate is not diminished during heating, which might affect heating efficiency.

Figure 8:
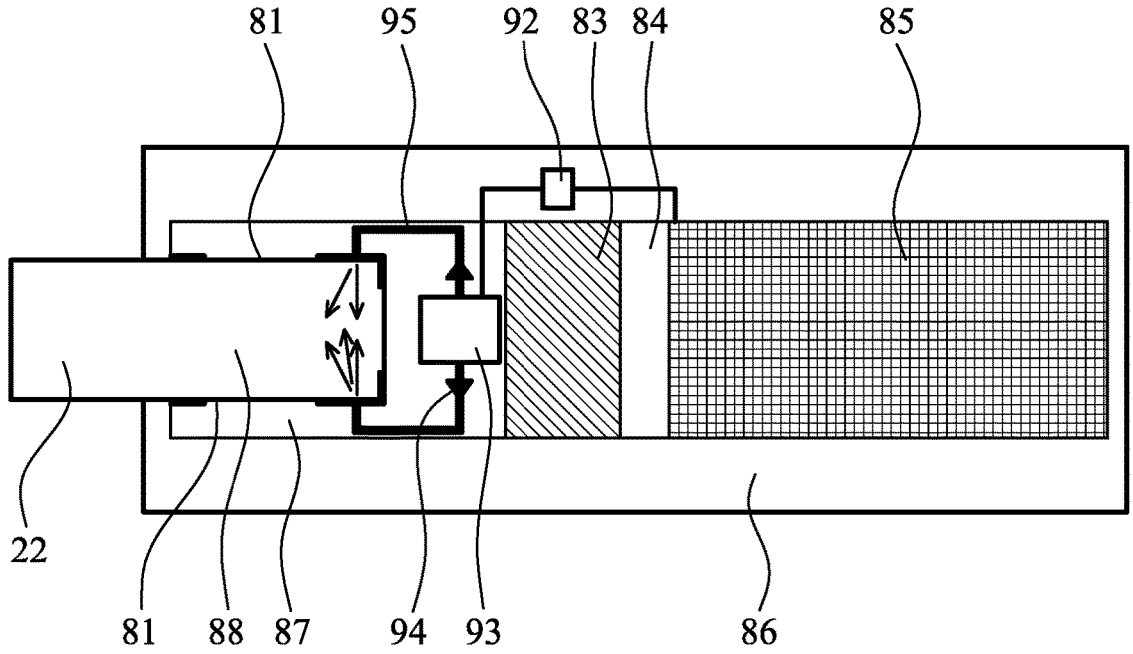
FIG. 8 is a schematic illustration of a sixth embodiment of an aerosol-generating system.

Another possibility is to inject or pump liquid into the substrate cavity just prior to use or during use. FIG. 8 is a schematic illustration of an embodiment of an aerosol-generating system similar to the embodiment of FIG. 2, but in which liquid from a liquid reservoir is pumped into the aerosol-forming substrate during heating of the substrate.

The system of FIG. 8 comprises an aerosol-generating article 22 received within the housing 86 of an aerosol-generating device. The aerosol-generating device comprises a power source 85, control circuitry 84, an RF electromagnetic field generator 83 comprising a solid state RF transistor, and a substrate cavity 88 in which the aerosol-generating article 22 is received. Surrounding the substrate cavity 88, is a radiation containment cavity 87, through which the electromagnetic radiation generated by the RF electromagnetic field generator can travel. Slots 81 are provided in the substrate cavity to allow radiation to pass from the radiation containment cavity into the substrate cavity.

The aerosol-generating device comprises a liquid reservoir containing a liquid aerosol former, such as glycerol, and water. Liquid conduit 95 lead from the liquid reservoir 94 to the substrate cavity 88. Pumps 94 are configured to pump the liquid from the liquid reservoir into the substrate cavity at a controlled rate. By pumping liquid into the substrate cavity, heating efficiency can be improved. Control module 92 is connected to the control circuitry 84 for the electromagnetic field generator 83. Operation of the pumps 94 can be coordinated with operation of the electromagnetic field generator, and in response to a sensed temperature within the substrate cavity. The pumps may be, for example, piezoelectric micro pumps.

Figure 9:
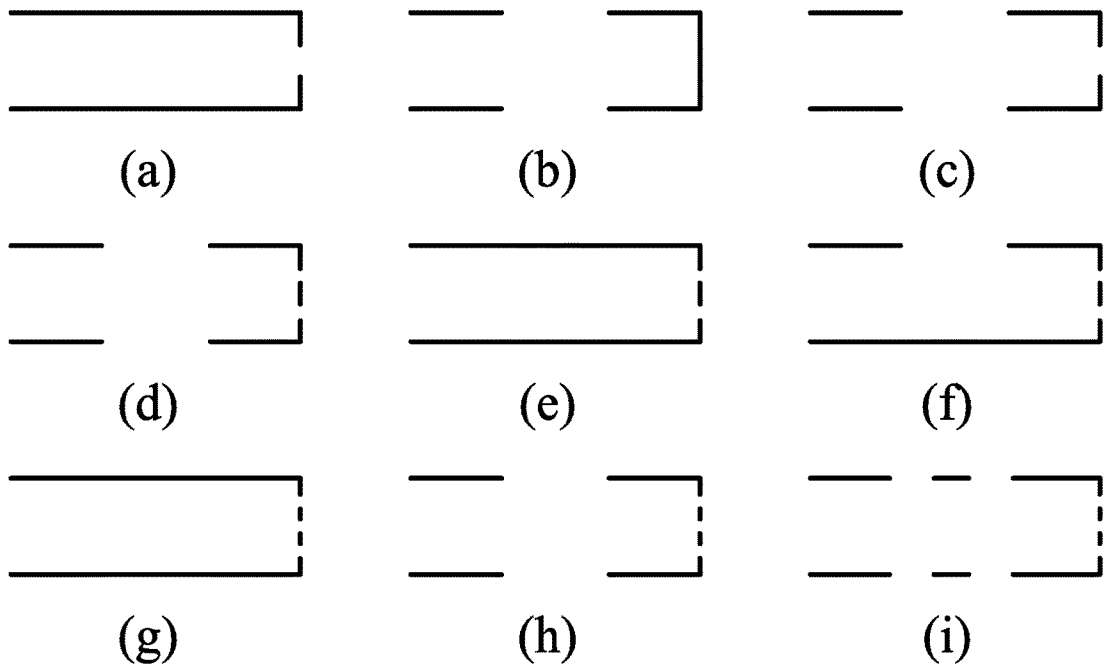
FIG. 9 is a schematic illustration of possible configurations for slots in a substrate cavity.

The slots that are provided to allow RF radiation into the aerosol-forming substrate can be in various positions. FIG. 9 illustrates various possibilities for the positions of slots. Option a) comprises a single slot in the closed end of the substrate cavity. Option b) comprises diametrically opposed slots in the sidewall of the cavity. Option c) comprises both a slot in the closed end and diametrically opposed slots in the sidewall of the cavity. Option d) comprises two slots in the closed end and diametrically opposed slots in the sidewall of the cavity. Option e) comprises just two slots in the closed end of the cavity. Option f) comprises two slots in the closed end and a single slot in the sidewall of the cavity. Option g) comprises three slots in the closed end of the cavity. Option h) comprises three slots in the closed end of the cavity and two diametrically opposed slots in the sidewall of the cavity. Option i) comprises three slots in the closed end of the cavity and two pairs of diametrically opposed slots in the sidewall of the cavity. These are just some example configurations. Each slot can have a particular shape. For example, some or all of the slots can be I shaped, L shaped, S shaped or T shaped. Some or all of the slots may be circular, or oval or rectangular.

It should be clear that, particularly in embodiments in which the walls of the substrate cavity are transparent to RF radiation, the aerosol-generating article can have a wrapper or casing that is opaque to RF radiation and slots or windows can be provided in various configurations in the wrapper or casing to allow the RF radiation to penetrate the aerosol-forming substrate.

Figure 10:
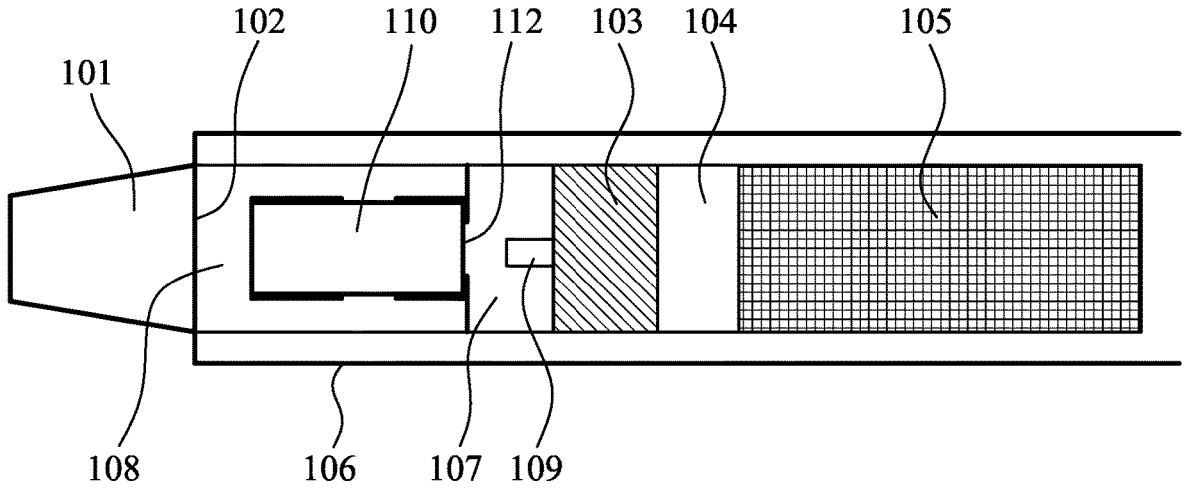
FIG. 10 is a schematic illustration of a seventh embodiment of an aerosol-generating system.

In the embodiments described so far, the aerosol-forming substrate has been provided in an aerosol-generating article on which the user puffs. FIG. 10 illustrates an alternative embodiment in which the aerosol-generating article is positioned with the aerosol-generating device. The aerosol-generating system of FIG. 10 comprises a mouthpiece portion on which the user puffs that is part of the device, and a capsule 110 containing the aerosol-forming substrate received entirely within the device housing 106.

The system of FIG. 10 comprises an aerosol-generating capsule 110 received within the housing 106 of an aerosol-generating device. The aerosol-generating device comprises a power source 105, control circuitry 104, an RF electromagnetic field generator 103 comprising a solid state RF transistor, and a substrate cavity 108 in which the aerosol-generating capsule 110 is received. Positioned between the RF electromagnetic field generator 103 and the substrate cavity is a resonating cavity 107. An antenna 109, which is connected to an output of the electromagnetic field generator 103, is located in the resonating cavity, as described with reference to the embodiment of FIG. 7. The outer surface of the capsule is generally opaque to RF radiation, but windows 112 that are transparent to the RF electromagnetic field are provided to allow the radiation to penetrate the capsule. The capsule may, for example, be provided with a plastic coating that is transparent to the RF radiation.

The mouthpiece portion 101 is fixed to the housing 106 to cover the capsule. The mouthpiece may be attached to the device housing by a screw fitting, snap fitting, hinge or in any other way. The mouthpiece portion 101 includes a metal mesh radiation shield 102, through which generated aerosol can pass.

Airflow inlets (not shown) may be provided in the housing 106 to allow air to be drawn into the device, past an outlet of the capsule 110 (or through the capsule) and out through the mouthpiece of the aerosol-generating device.

Figure 11:
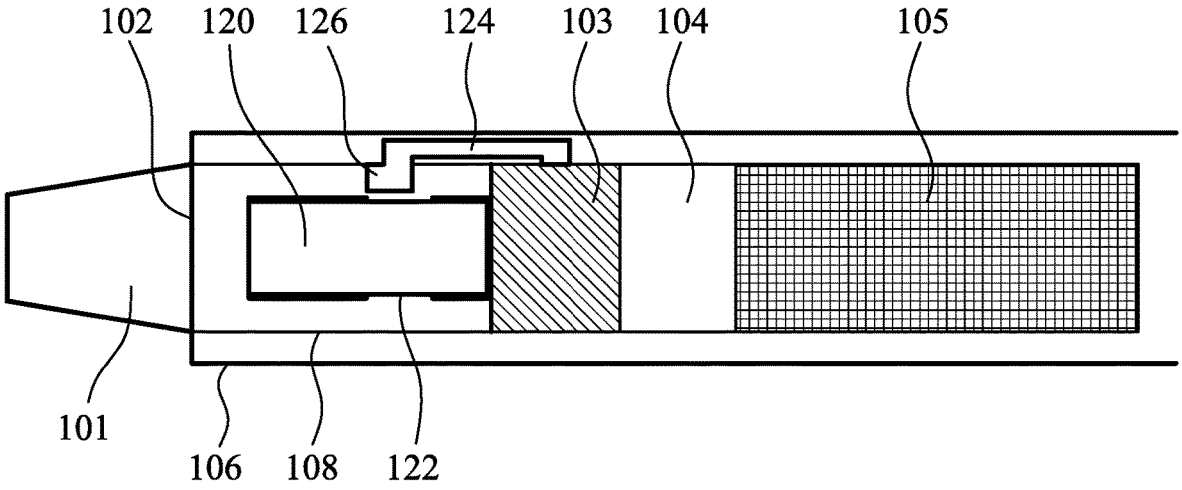
FIG. 11 is a schematic illustration of an eighth embodiment of an aerosol-generating system.

FIG. 11 illustrates another embodiment, similar to the embodiment of FIG. 10, but in which a waveguide is provided instead of a resonating cavity. The features identical to the embodiment of FIG. 10 are provided with identical reference numerals. The aerosol-generating device comprises a power source 105, control circuitry 104, an RF electromagnetic field generator 103 comprising a solid state RF transistor, and a substrate cavity 108 in which the aerosol-generating capsule 120 is received. In the embodiment of FIG. 11 the RF radiation is guided from the electromagnetic field generator 103 through a waveguide 124 to an antenna 126 positioned adjacent to a window in a sidewall of the capsule 120. Again, the outer surface of the capsule is generally opaque to RF radiation, but windows 122 that are transparent to the RF electromagnetic field are provided to allow the radiation to penetrate the capsule. A window 122 is positioned on the opposite side of the capsule to the window through which radiation enters the cavity to allow the RF electromagnetic field to be sampled by a sampling antenna, as will be described.

In the embodiments shown in FIGS. 10 and 11, the capsules are filled with a gel or liquid aerosol-forming substrate, although the same range of substrates may be used as described with reference to the preceding embodiments. The gel may comprise a large proportion of glycerol, together with nicotine and flavourants. The liquid may comprise a mixture of one or more aerosol formers, such as glycerol and propylene glycol, water, nicotine and flavourants. In one example, the liquid in the capsule of FIG. 11 comprises 39% (by weight) glycerol, 39% propylene glycol, 20% water and 2% nicotine. In another example, the liquid comprises 58% (by weight) glycerol, 20% propylene glycol, 20% water and 2% nicotine.

Figure 12:
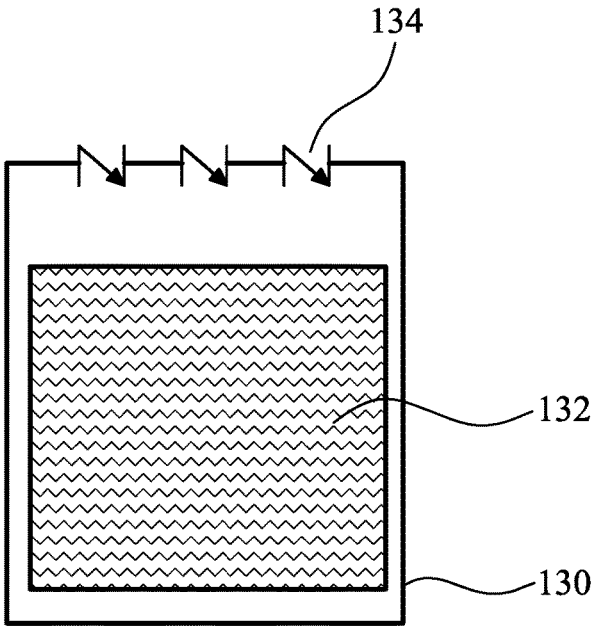
FIG. 12 is a schematic illustration of a liquid capsule.

FIG. 12 is a schematic illustration of a possible mechanism for allowing the escape of aerosol from a gel or liquid filled capsule for use in the embodiments of FIG. 10 or 11. The capsule of FIG. 12 comprises a metallic housing 130, which may be refillable with the gel or liquid aerosol-forming substrate 132. Windows are formed in the capsule housing to allow for ingress of the RF radiation so that the gel or liquid can be heated. Valves 134 are provided at a mouthpiece end of the capsule. When a user draws on the mouthpiece of the system, the reduction in pressure within the mouthpiece pulls the valves open, allowing vapour and aerosol to escape the capsule and be drawn into the user's mouth. The heating of the gel or liquid may also increase pressure within the capsule, providing a further opening force on the valves 134.

In all of the embodiments described, it is desirable to be able to regulate the temperature of the aerosol-forming substrate. The ability to use feedback control to adjust the frequency or amplitude of the electromagnetic field is one of the benefits of using a solid state RF transistor.

Figure 13:
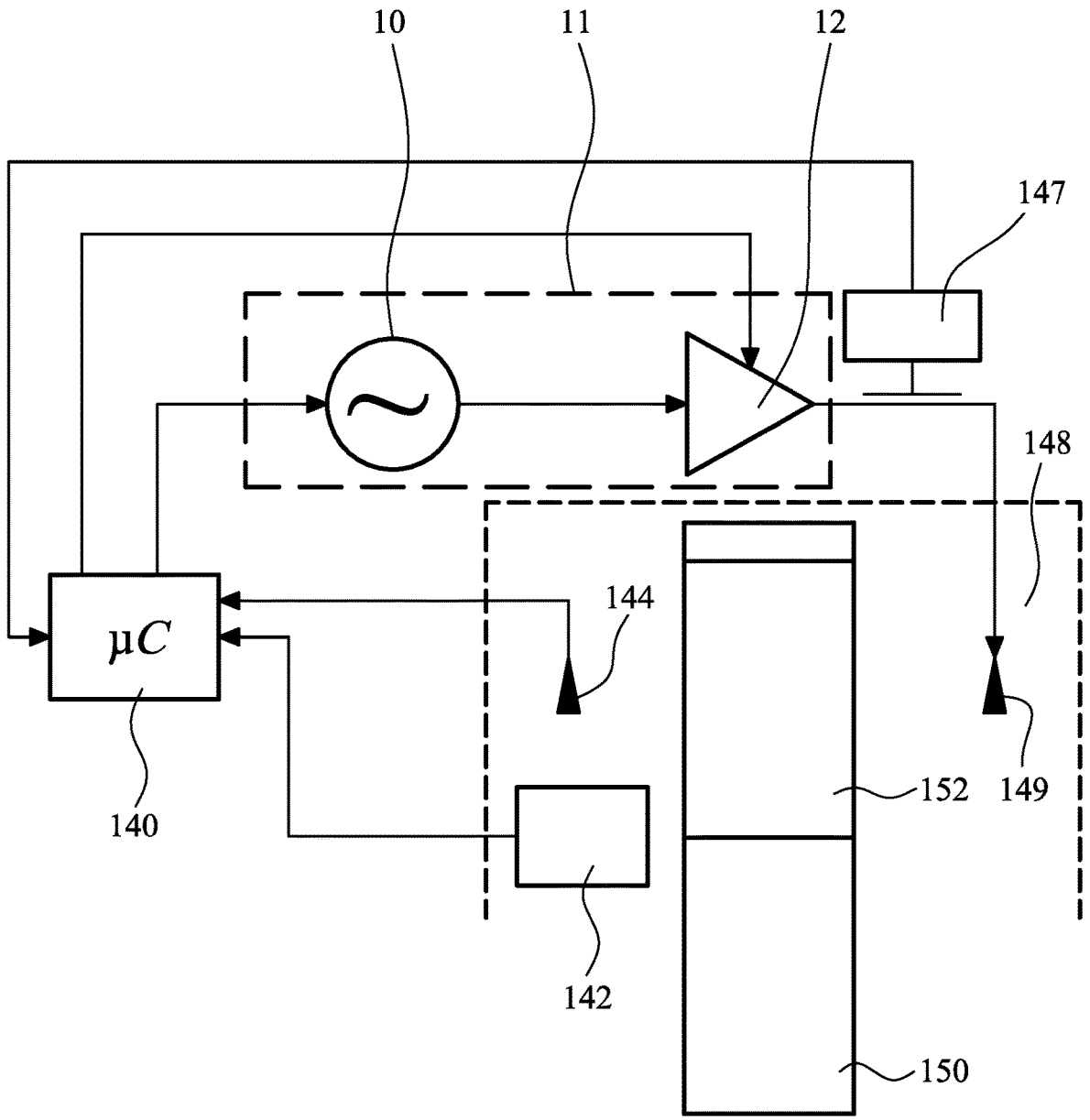
FIG. 13 is a schematic illustration of a closed-loop control system for an aerosol-generating system in accordance with any of the described embodiments.

FIG. 13 illustrates a control scheme that may be used in any of the described embodiments. As previously described, the system comprises control circuitry for the electromagnetic field generator. In the example of FIG. 13, the electromagnetic field generator 11 comprises a solid state RF LDMOS transistor that perform the function of both an RF signal generator 10 and a power amplifier 12 to amplify the generated RF electromagnetic signal. The output of the RF solid state transistor 11 is passed to a radiating antenna 149 positioned to radiate an aerosol-forming substrate 152 positioned within an aerosol-generating article 150 that is received in the substrate cavity 148.

The control circuitry comprises a microcontroller 140 that can control both the frequency and the power output of the RF solid state transistor. One or more sensors provide input to the microcontroller. The microcontroller adjusts the frequency or the power output, or both the frequency and the power output, of the electromagnetic field generator based on the sensor inputs. In the example shown in FIG. 13, there is a temperature sensor 142 positioned to sense the temperature within the substrate cavity. A sampling antenna 144 may be provided in the cavity as an alternative, or in addition, to the temperature sensor. The sampling antenna is configured as a receiver and can detect perturbation of the electromagnetic field in the substrate cavity, which is an indication of the efficiency of the energy absorption by the aerosol-forming substrate. An RF power senor 147 is also provided to detect the power output from the electromagnetic field generator.

The microcontroller 140 receives signals from the RF power sensor, the temperature sensor 142 and the sampling antenna 144. The signals can be used to determine: whether the temperature is too low, the temperature is too high, if there is a fault and if there is no substrate, or a substrate with inappropriate dielectric properties, in the substrate cavity. A substrate with inappropriate substrate properties may be a substrate in which the liquid or gel content has been depleted through use and so needs to be replaced.

Based on the determination made by the microcontroller 140, the frequency and power of the electromagnetic filed generated by the RF solid state transistor 11 is adjusted or the electromagnetic field is switched off. Typically, it is desirable to provide for a stable and consistent volume of aerosol, which means maintaining the aerosol-forming substrate within a particular temperature range. However, the desired target temperature may vary with time as the composition of the aerosol-forming substrate changes and the temperature of the surrounding system changes. Also, the dielectric properties of the aerosol-forming substrate change with temperature and so the electromagnetic field may need to be adjusted as temperature increases or decreases.

It should be clear that features described in relation one embodiment may be applied to other embodiments. The embodiments described provide the advantages of uniform, contactless heating of an aerosol-forming substrate in a manner that can be controlled to provide for particular, desirable aerosol properties. In comparison to conventional microwave heating using a magnetron, the use of a solid state RF transistor provides for a compact system that can be implemented as a handheld system. The use of a solid state RF transistor also allows for better control of frequency and power and longer operational lifetime.

The invention claimed is:

1. An aerosol-generating device for heating an aerosol-forming substrate to generate an aerosol, the aerosol-generating device comprising:

a substrate cavity configured to receive an aerosol-forming substrate; and an electromagnetic field generator comprising a solid state radio frequency (RF) transistor and being configured to generate a RF electromagnetic field in the substrate cavity.

2. The aerosol-generating device according to claim 1, wherein the solid state RF transistor is configured to generate and to amplify the RF electromagnetic field.

3. The aerosol-generating device according to claim 1, wherein the substrate cavity comprises one or more external walls formed from a material opaque to the RF electromagnetic field, and wherein one or more slots are formed in the one or more external walls.

4. The aerosol-generating device according to claim 1, wherein the substrate cavity comprises a blind cavity configured to receive an aerosol-forming article containing the aerosol-forming substrate.

5. The aerosol-generating device according to claim 1, further comprising a resonating cavity between the substrate cavity and the electromagnetic field generator.

6. The aerosol-generating device according to claim 1, further comprising an antenna connected to the electromagnetic field generator configured to direct the RF electromagnetic field.

7. The aerosol-generating device according to claim 6, wherein the antenna is positioned at least partially in the substrate cavity.

8. The aerosol-generating device according to claim 1, further comprising a sensor in or adjacent to the substrate cavity, the sensor providing a signal indicative of a temperature in the substrate cavity, and a controller connected to receive the signal from the sensor and connected to control the electromagnetic field generator in dependence on the signal from the sensor.

9. The aerosol-generating device according to claim 1, further comprising a liquid reservoir and a liquid pump configured to deliver liquid from the liquid reservoir to the substrate cavity.

10. An aerosol-generating system, comprising:

an aerosol-generating device in accordance with claim 1; and an aerosol-forming substrate received in the substrate cavity.

11. The aerosol-generating system according to claim 10, wherein the aerosol-forming substrate comprises tobacco.

12. The aerosol-generating system according to claim 10, wherein the aerosol-forming substrate comprises a liquid-filled capsule or a gel-filled capsule.

13. The aerosol-generating system according to claim 12, wherein the liquid-filled capsule or gel-filled capsule is configured to rupture when the liquid or gel is heated by the RF electromagnetic field in the substrate cavity.

14. A method for generating an aerosol from an aerosol-forming substrate, the method comprising:

placing the aerosol-forming substrate within a substrate cavity of an aerosol-generating device; and generating a radio frequency (RF) electromagnetic field in the substrate cavity using a solid state RF transistor.

15. An aerosol-generating article, comprising:

an aerosol-forming substrate;

a mouthpiece through which a user can draw generated aerosol or vapour; and a fluid permeable, radio frequency electromagnetic radiation shield positioned between the aerosol-forming substrate and the mouthpiece.

* * * * *